US005809912A

United States Patent [19]

Hansen et al.

[11] Patent Number: 5,809,912

[45] Date of Patent: Sep. 22, 1998

[54] HEAT EXCHANGER AND A COMBUSTION SYSTEM AND METHOD UTILIZING SAME

[75] Inventors: Arthur Magne Hansen, East Hanover, N.J.; Stephen John Goidich, Palmerton, Pa.

[73] Assignee: Foster Wheeler Energy, Inc., Clinton, N.J.

[21] Appl. No.: 660,975

[22] Filed: Jun. 11, 1996

[51] Int. Cl.[6] ..... F23D 1/00

[52] U.S. Cl. ..... 110/347; 110/348; 110/245; 110/263; 165/104.16; 122/4 D

[58] Field of Search ..... 110/245, 348, 110/347, 216, 263; 122/4 D; 165/104.16; 432/15, 58

[56] References Cited

U.S. PATENT DOCUMENTS

| | | | |
|---|---|---|---|
| 4,756,360 | 7/1988 | Rawdon et al. . | |
| 4,827,723 | 5/1989 | Engstrom et al. . | |
| 4,944,150 | 7/1990 | Ostman . | |
| 4,955,190 | 9/1990 | Robertson, Jr. . | |
| 5,014,652 | 5/1991 | Hyldgaard . | |
| 5,040,492 | 8/1991 | Dietz . | |
| 5,054,436 | 10/1991 | Dietz | 110/245 X |
| 5,069,170 | 12/1991 | Gorzegno et al. . | |
| 5,123,480 | 6/1992 | Dixit . | |
| 5,133,943 | 7/1992 | Abdulally . | |
| 5,140,950 | 8/1992 | Abdulally . | |
| 5,141,047 | 8/1992 | Geoffroy . | |
| 5,141,708 | 8/1992 | Campbell, Jr. et al. . | |
| 5,253,741 | 10/1993 | Gorzegno | 110/245 X |
| 5,273,000 | 12/1993 | Regan . | |
| 5,537,941 | 7/1996 | Goidich | 110/348 X |

*Primary Examiner*—Henry A. Bennett
*Assistant Examiner*—Susanne C. Tinker
*Attorney, Agent, or Firm*—Haynes adn Boone, L.L.P.

[57] ABSTRACT

A heat exchanger and a fluidized bed combustion system and method utilizing same in which the heat exchanger includes a plurality of stacked sections. The sections include an inlet section for receiving the particles and a plurality of stacked sections and are arranged in such a manner that the particles are introduced into an upper level of the sections and pass through these sections to a lower level of sections before returning to the furnace. A portion of the stacked sections contain heat exchange surfaces for removing heat from the particles, and a multi-sectioned outlet compartment is provided to receive the separated particles from the heat exchange sections and directly from the inlet section and pass the particles back to the furnace.

24 Claims, 3 Drawing Sheets

HEAT EXCHANGER AND A COMBUSTION SYSTEM AND METHOD UTILIZING SAME

BACKGROUND OF THE INVENTION

This invention relates to a recycle heat exchanger and a fluidized bed combustion system and method incorporating same, and, more particularly, to such a heat exchanger, system and method in which solids from a combustor are recycled through the heat exchanger and back to the combustor.

According to prior art fluidized bed combustion systems and methods, air is passed through a bed of particulate material, including a fossil fuel, such as coal, and a sorbent for the oxides of sulfur generated as a result of combustion of the coal, to fluidize the bed and to promote the combustion at a relatively low temperature. These types of systems are often used in steam generators in which water is passed in a heat exchange relationship to the fluidized bed to generate steam and permit high combustion efficiency, fuel flexibility, high sulfur adsorption and low nitrogen oxides emissions. These types of systems often utilize a "circulating" fluidized bed in which the entrained solid particles of fuel and sorbent (hereinafter referred to as "solids") from the furnace are separated from the mixture of fluidizing air and combustion gases (hereinafter referred to as "flue gases") and are recycled back to the furnace.

In these circulating beds, the fluidized bed density is relatively low when compared to other types of fluidized beds, the fluidizing air velocity is relatively high, and the flue gases passing through the bed entrain a substantial amount of the fine solids to the extent that they are substantially saturated therewith.

The relative high solids recycling is achieved by disposing a cyclone separator at the furnace section outlet to receive the flue gases, and the solids entrained thereby, from the fluidized bed. The solids are separated from the flue gases in the separator and the flue gases are passed to a heat recovery area while the solids are recycled back to the furnace. This recycling improves the efficiency of the separator, and the resulting increase in the efficient use of sulfur adsorbent and fuel residence times reduces the adsorbent and fuel consumption. Also, the relatively high internal and external solids recycling makes the circulating bed relatively insensitive to fuel heat release patterns, thus minimizing temperature variations and, therefore stabilizing the sulfur emissions at a low level.

When the circulating fluidized bed combustors are utilized in a steam generating system, the combustor is usually in the form of a conventional, water-cooled enclosure formed by a welded tube and membrane construction so that water and steam can be circulated through the wall tubes to remove heat from the combustor. However, in order to achieve optimum fuel burn-up and emissions control, additional heat must be removed from the system. This heat removal has been achieved in the past by several techniques. For example, the height of the furnace has been increased or heat exchange surfaces have been provided in the upper furnace to cool the entrained solids before they are removed from the furnace, separated from the flue gases and returned to the furnace. However these techniques are expensive and the heat exchange surfaces are wear-prone. Other techniques involve the deployment of an additional, separate heat exchanger between the outlet of the separator and the recycle inlet of the furnace. Although heat can be removed from the recycled solids in this separate heat exchanger before the solids are passed back into the furnace, these type of arrangements are not without problems. For example, it is difficult to precisely control the heat transfer rates in the recycle heat exchanger. Also, during start-up or load low conditions, it is often difficult to bypass the heat exchange surfaces in the recycle heat exchanger. Further, in situations when the recycle heat exchanger is formed integrally with the furnace, there is often an increase in boiler plan area which adds to the cost of the system.

SUMMARY OF THE INVENTION

It is therefore an object of the present invention to provide a recycle heat exchanger and a fluidized bed combustion system and method incorporating same in which the recycle heat exchanger selectively removes heat from the recycled solids.

It is a further object of the present invention to provide a heat exchanger, system and method of the above type in which the amount of heat removed from the recycled solids can be precisely controlled.

Towards the fulfillment of these and other objects, according to the present invention a fluidized bed of fuel particles is established in a furnace and the flue gases produced as a result of combustion of the fuel particles entrain a portion of the particles. The entrained particles are separated from the flue gases and a heat exchanger is provided for receiving the separated particles. The heat exchanger includes an inlet compartment for receiving the separated particles, at least one heat exchange compartment for cooling the particles and two or more outlet compartments for discharging the particles back to the furnace. The particles in the compartments are selectively fluidized so that they pass from the inlet compartment through one of the outlet compartments and back to the furnace, or from the inlet compartment, through both of the outlet compartments and back to the furnace.

BRIEF DESCRIPTION OF THE DRAWINGS

The above objects and summary, as well as further objects, features and advantages of the present invention will be more fully appreciated by reference to the following detailed description of the presently preferred, but nevertheless illustrative, embodiments of the present invention when taken in conjunction with the accompanying drawings wherein.

DESCRIPTION OF THE PREFERRED EMBODIMENT

Figure 1:
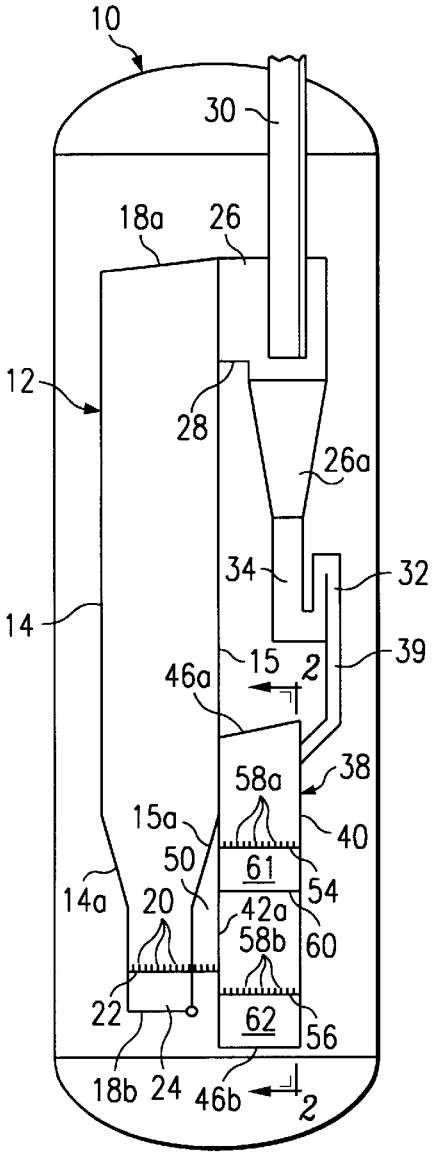
FIG. 1 is a schematic representation depicting the combustion system and the recycle heat exchanger of the present invention.
Figure 3:
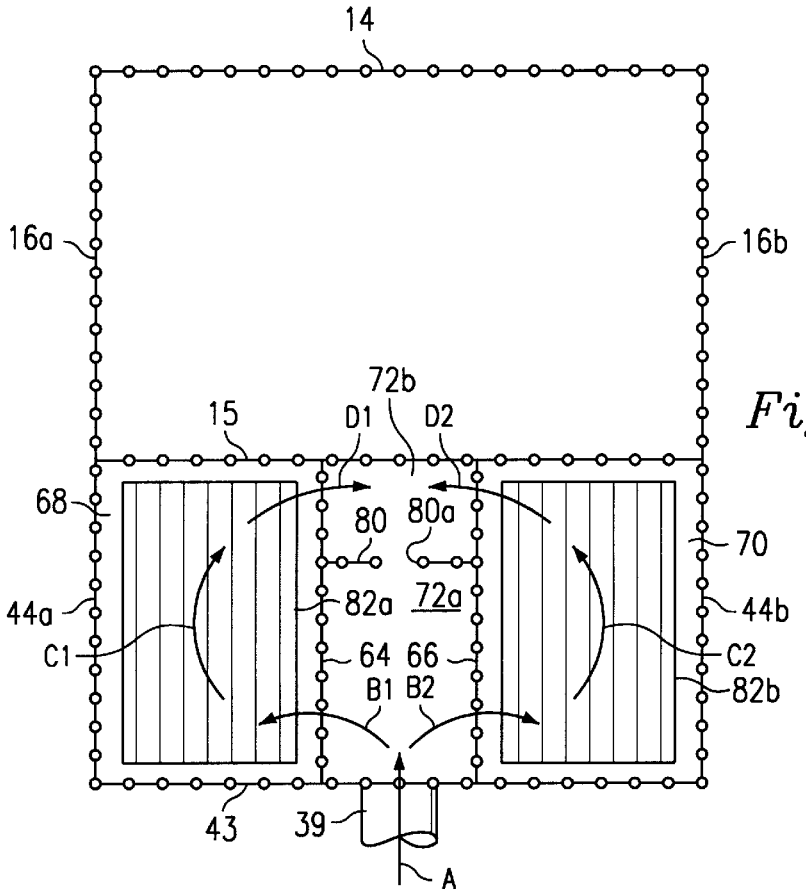
FIGS. 3, 4 and 5 are cross-sectional views taken along the lines 3—3, 4—4 and 5—5, respectively, of FIG. 2.

The drawings depict the fluidized bed combustion system of the present invention used for the generation of steam and including an upright pressure vessel 10 in which is disposed a water-cooled furnace enclosure, referred to in general by the reference numeral 12. The furnace enclosure 12 includes a front wall 14, a rear wall 15 and two sidewalls 16*a* and 16*b* (FIG. 3). As shown in FIG. 1, the lower portions 14*a* and 15*a* of the walls 14 and 15, respectively, converge inwardly for reasons to be explained. The upper portion of the enclosure 12 is enclosed by a roof 18*a* and a floor 18*b* defines the lower boundary of the enclosure. It is understood that an air inlet duct (not shown) connects to the lower portion of the pressure vessel 10 for introducing pressurized air from an external source, such as a compressor driven by a gas turbine, or the like.

A plurality of air distributor nozzles 20 are mounted in corresponding openings formed in a horizontal plate 22 extending across the lower portion of the enclosure 12. The plate 22 is spaced from the floor 18 to define an air plenum 24 which is adapted to receive air contained in the vessel 10 and selectively distribute the air through the plate 22 and to portions of the enclosure 12, as will be described.

It is understood that a fuel feeder system (not shown) is provided for introducing particulate material including fuel into the enclosure. The particulate material is fluidized by the air from the plenum 24 as it passes upwardly through the plate 22. The air promotes combustion of the fuel and the flue gases thus formed rise in the enclosure 12 by forced convection and entrain a portion of the solids to form a column of decreasing solids density in the enclosure to a given elevation, above which the density remains substantially constant.

A cyclone separator 26 extends adjacent the enclosure 12 inside the vessel 10 and is connected to the enclosure by a duct 28 extending from an outlet provided in the rear wall 15 of the enclosure to an inlet provided through the separator wall. The separator 26 receives the flue gases and the entrained particulate material from the enclosure in a manner to be described and operates in a conventional manner to disengage the particulate material from the flue gases due to the centrifugal forces created in the separator.

The separated flue gases, which are substantially free of solids enter a duct 30 projecting upwardly through the upper portion of the separator 26 and the vessel 10 for passage into a hot gas clean-up and a heat recovery section (not shown) for further treatment. The lower portion of the separator includes a hopper 26*a* which is connected to a conventional "J-valve" 32 by a dip leg 34.

Figure 4:
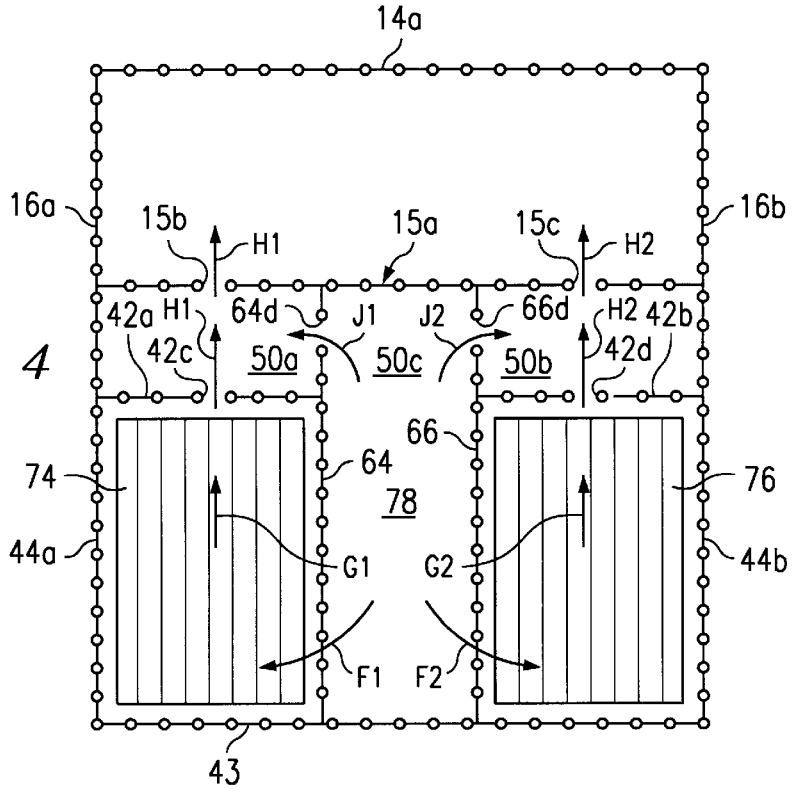
Figure 5:
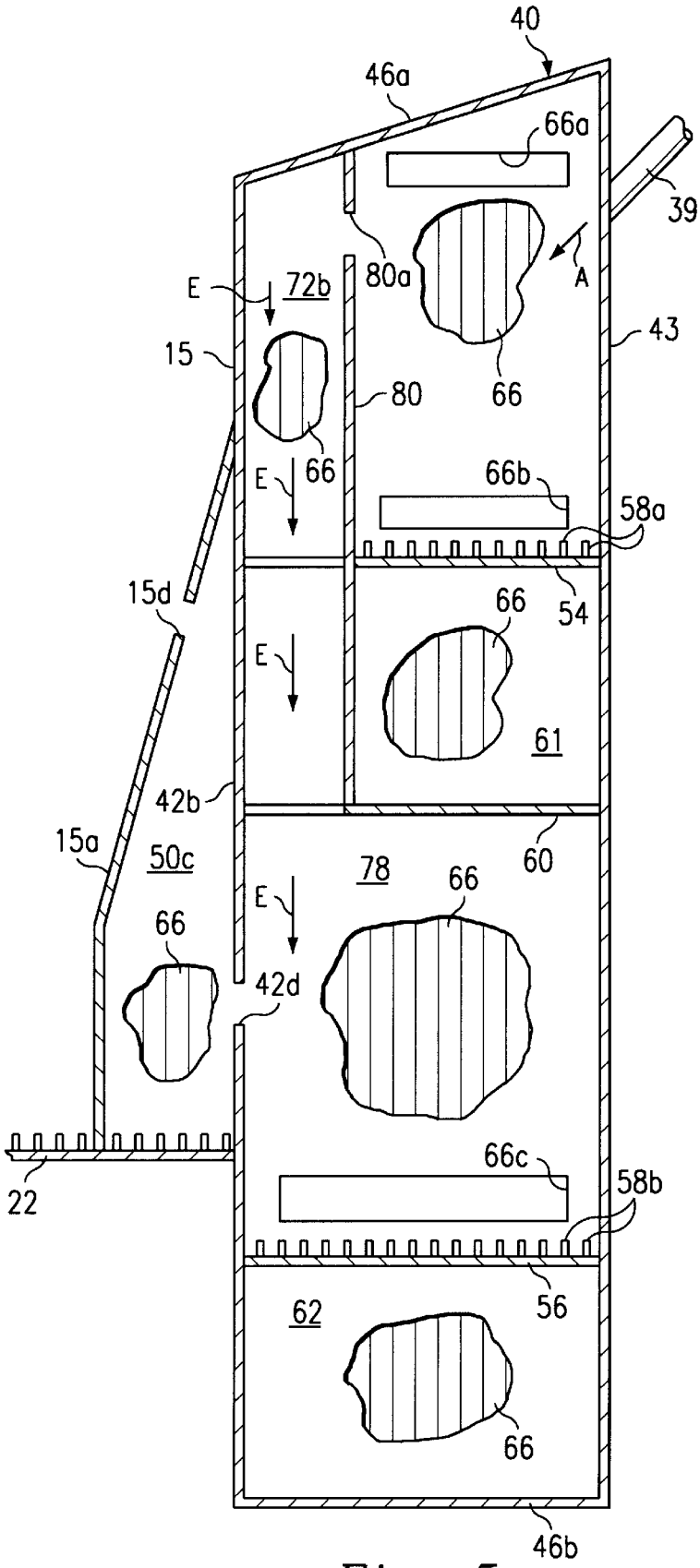

The heat exchanger 38 of the present invention is located adjacent the enclosure 12 and within the vessel 10, and is connected to the outlet of the J-valve 32 by a duct 39. The heat exchanger 38 includes an enclosure 40 formed by two front wall portions 42*a* and 42*b*, a rear wall 43, two sidewalls 44*a* and 44*b* (FIG. 2), a roof 46*a* and a floor 46*b*. As shown in FIGS. 1, 3, and 4, a large portion of the sidewalls 44*c* and 44*b* are formed by extension of the sidewalls 16*a* and 16*b* of the furnace enclosure 12. Also, as shown in FIG. 1, the front wall portions 42*a* and 42*b* form lower extensions of corresponding portions of the rear enclosure wall 15 that extends just above the converging portion 15*a*. As shown in FIGS. 1 and 5, the plate 22 extends to the wall 42 to form a solids outlet compartment 50 defined above the latter extension and between the converging portion 15*a* of the enclosure rear wall 15 and the front wall portions 42*a* and 42*b* of the enclosure 40.

Figure 2:
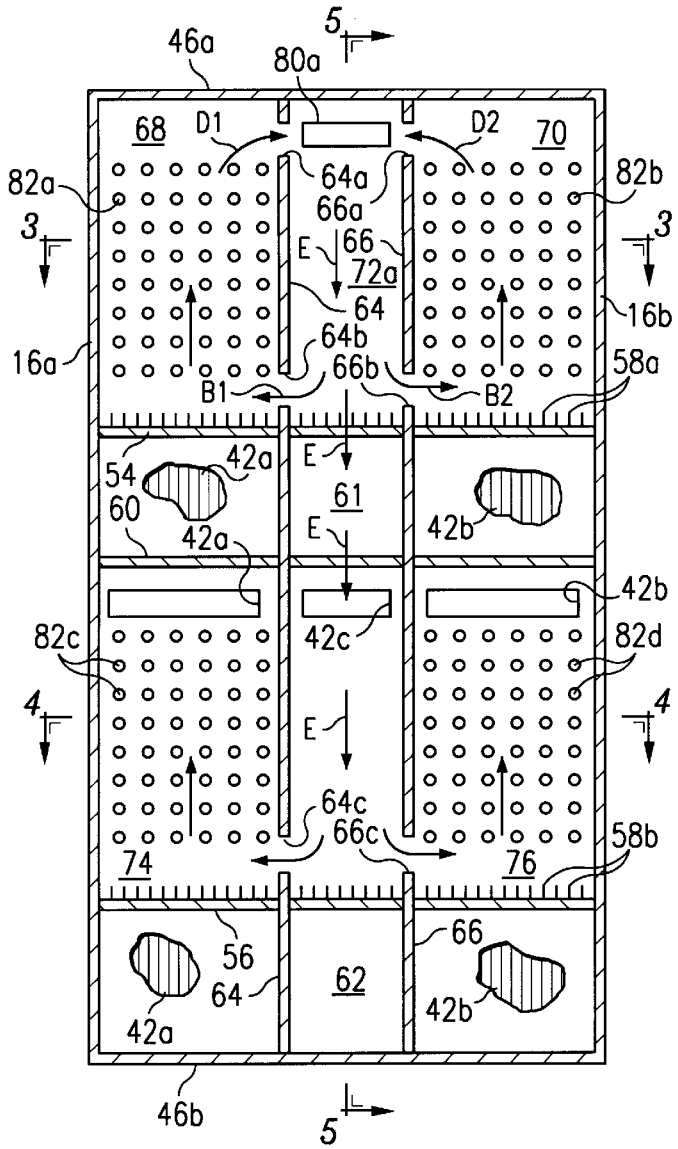
FIG. 2 is a cross-sectional view taken along the line 2—2 of FIG. 1.

Two horizontal, vertically-spaced, plates 54 and 56 (FIGS. 1, 2 and 5) are disposed in the enclosure 40 and receive two groups of air distributor nozzles 58*a* and 58*b*, respectively. A third horizontal plate 60 is disposed in the enclosure 40 and extends between the plates 54 and 56 to generally divide the enclosure into an upper portion and a lower portion. As shown in FIG. 2, a plenum section 61 is defined between the plates 54 and 60 for supplying air to the nozzles 58*a*, and a plenum section 62 is defined between the plate 56 and the floor 46*b* for supplying air to the nozzles 58*b*.

As shown in FIGS. 2 and 3, a pair of spaced, parallel vertical plates 64 and 66 extend between the rear wall 43 of the enclosure 40 and the wall 15 (and the wall 42) in a spaced parallel relationship to the sidewalls 44*a* and 44*b*. The plates 64 and 66 thus divide the upper portion of enclosure 40 into two heat exchange sections 68 and 70, respectively extending to the sides of a inlet/bypass section 72 (FIGS. 2 and 3). The plates 64 and 66 also divide the lower portion of the enclosure 40 into two heat exchange sections 74 and 76 respectively extending to the sides of a transfer section 78 (FIGS. 2 and 4). As shown in FIG. 2, three openings 64*a*, 64*b*, and 64*c* are formed in the plate 64 and three openings 66*a*, 66*b* and 66*c* are formed in the plate 66 to permit the flow of solids between the upper sections 68, 70, and 72, as well as between the lower sections 74, 76 and 78 as will be described.

As shown in FIG. 2, the plates 64 and 66 also divide the plenum 61 into three sections respectively extending below the sections 74, 76, and 78 and, in addition, divide the plenum 62 into three sections respectively extending below the sections 74, 76, and 78.

It is understood that pressurized air from the vessel 10 is selectively introduced into the aforementioned plenum sections at varying velocities in a conventional manner, for reasons to be described.

A vertical partition 80 (FIGS. 3 and 5) extends from the horizontal plate 60 to the roof 46*a* and divides the inlet/bypass compartment 72 into two sections 72*a* and 72*b*. An opening 80*a* is provided in the upper portion of the partition 80 to communicate the compartment section 72*a* with the section 72*b*. The portion of the plate 54 that defines the compartment 72*a*, as well as the corresponding portion of the plate 60, each terminates at the partition 80 and thus does not extend to the wall 15. Thus the compartment section 72*b* communicates with the section 78 for reasons that will be described.

With reference to FIG. 4, the lower portions of the walls 64 and 66 extend past the front wall portions 42*a* and 42*b* and to the wall portion 15*a*. This divides the outlet compartment into two spaced sections 50*a* and 50*b* and an intermediate section 50*c* extending between the spaced sections and forming an extension of the lower bypass section 78. Openings 64*d* and 66*d* extend through the respective extended portions of the walls 64 and 66 for reasons to be described.

Four bundles 82*a*, 82*b*, 82*c*, and 82*d* of heat exchange tubes (FIGS. 2–4) are disposed in the heat exchange sections 68, 70, 74, and 76, respectively and are connected in a conventional manner to a fluid flow circuit (not shown) to circulate cooling fluid through the tubes to remove heat from the solids in the sections, in a conventional manner.

As shown in FIG. 4, two spaced openings 15*b* and 15*c* are provided in the lower, vertical wall portion 15*a* and two openings 42*c* and 42*d* are formed through the wall portions 42*a* and 42*b*, respectively.

It is understood that all of the foregoing walls, plates and partitions are formed of a conventional welded membrane and tube construction shown and described in U.S. Pat. No. 5,069,171 assigned to the assignee of the present application, the disclosure of which is incorporated by reference. It is also understood that a steam drum is provided adjacent the vessel and a plurality of headers, downcomers and the like are provided to establish a fluid flow circuit including the foregoing tubed walls. Thus, water is passed in a predetermined sequence through this flow circuitry to convert the water to steam by the heat generated by the combustion of the fuel solids in the furnace enclosure 12.

In operation, the solids are introduced into the furnace enclosure 12 in any conventional manner where they accumulate on the plate 20. Air is introduced into the pressure vessel 10 and passes into the plenum 24 and through the plate 20 before being discharged by the nozzles 22 into the solids on the plate 20, with the air being at sufficient velocity and quantity to fluidize the solids.

A lightoff burner (not shown), or the like, is provided to ignite the fuel material in the solids, and thereafter the fuel portions of the solids is self-combusted by the heat in the furnace enclosure 12. The flue gases pass upwardly through the furnace enclosure 12 and entrain, or elutriate, a quantity of the solids. The quantity of the air introduced, via the plenum 24, through the nozzles 22 and into the interior of the enclosure 12 is established in accordance with the size of the solids so that a circulating fluidized bed is formed, i.e., the solids are fluidized to an extent that substantial entrainment or elutriation thereof is achieved. Thus, the flue gases passing into the upper portion of the furnace enclosure are substantially saturated with the solids and the arrangement is such that the density of the bed is relatively high in the lower portion of the furnace enclosure 12, decreases with height throughout the length of this enclosure and is substantially constant and relatively low in the upper portion of the enclosure.

The saturated flue gases in the upper portion of the furnace enclosure 12 exit into the duct 28 and pass into the cyclone separator 26. The solids are separated from the flue gases in the separator 26 in a conventional manner, and the clean gases exit the separator and the vessel 10 via the duct 30 for passage to hot-gas clean-up and heat recovery apparatus (not shown) for further treatment as described in the above-cited patent.

The separated solids in the separator 26 fall into the hopper 26*a* and exit the latter, via the dip leg 34 before passing through the J-valve 32 and, via the duct 39, into the enclosure 40 of the heat exchanger 38.

The separated solids from the duct 39 enter the inlet/bypass compartment section 72*a* of the enclosure 40 as shown by the flow arrow A in FIG. 3. In normal operation, air is introduced at a relatively high rate into the sections of the plenum 61 extending below the heat exchange sections 68 and 70 while air at a relatively low rate is introduced into the section of the plenum extending below the section 72*a*. As a result, the solids from the section 72*a* flow through the openings 64*b* and 66*b* (FIG. 2) in the partitions 64 and 66, respectively, and into the sections 68 and 70, as shown by the flow arrows B1 and B2 in FIGS. 2 and 3. The solids flow under and up through the heat exchange tube bundles 82*a* and 82*b* in the sections 68 and 70, as shown by the arrows C1 and C2 in FIGS. 2 and 3.

The solids thus build up in the sections 68 and 70 and spill through the openings 64*a* and 66*a* in the partitions 64 and 66 respectively, into the inlet/bypass compartment section 72*b*, as shown by the flow arrows D1 and D2 in FIGS. 2 and 3. The solids then fall, by gravity through the openings in the plates 54 and 60, respectively, and into the lower section 78, as shown by the flow arrows E in FIGS. 2 and 5.

Air at a relatively high rate is introduced into the sections of the lower plenum 62 extending below the lower heat exchange sections 74 and 76 while air at a relatively low rate is introduced into the section of the plenum 62 extending below the section 78. This promotes the flow of the solids from the section 78, through the openings 64*c* and 66*c* in the partitions 64 and 66, and into the heat exchange sections 74 and 76, as shown by the flow arrows F1 and F2, respectively, in FIGS. 2 and 4. The solids thus flow up through the tube bundles 82*c* and 82*d* in the sections 74 and 76, respectively, to transfer heat to the fluid flowing through the latter tubes. As shown in FIG. 4 by the flow arrows H1 and H2, the solids exit the sections 74 and 76 via openings 42*c* and 42*d*, respectively, in the wall 42 portions 42*a* and 42*b*, respectively, and pass into the sections 50*a* and 50*b*, respectively, of the outlet compartment 50 where they mix before passing, via the openings 15*b* and 15*c*, respectively, in the wall 15, back into the furnace enclosure 12. The fluidizing air from all of the heat exchange sections 68, 70, 74 and 76 also flows into the furnace enclosure 12 through the openings 42*c*, 42*d*, 15*b*, and 15*c*.

Feed water is introduced into, and circulated through, the flow circuit described above including the water wall tubes and the steam drum described above in a predetermined sequence to convert the water to steam and to superheat and reheat (if applicable) the steam.

During low loads, emergency shutdown conditions or start-up, a bypass operation is possible by terminating all air flow into the sections of the plenums 61 and 62 extending below the sections 68, 70, 74 and 76 and thus allowing the solids to build up in the inlet section 72*a* until their level reaches that of the weir port 80*a* in the partition 80, as shown in FIG. 5. Thus, the solids spill over into the section 72*b* of the inlet/bypass compartment 72 and fall down into the section 78. The solids thus build up in the section 78 and pass into the section 50*c* of the outlet compartment 50 until their level reaches that of the openings 64*d* and 66*d* of the extended portions of the walls 64 and 66*d* and into the sections 50*a* and 50*b*, respectively, of the outlet compartment 50. The solids then pass from the outlet compartment sections 50*a* and 50*b* through the openings 15*b* and 15*c* in the wall 15 and back into the furnace enclosure 12 at substantially the same temperature as when the solids entered the heat exchanger 38.

By selective control of the respective velocities of the air discharging into the heat exchange sections 68, 70, 74 and 76, the respective heat exchange with the fluid passing through the walls and partitions of the enclosure 40 can be precisely regulated and varied as needed. For example, in the bypass operation described above, instead of completely defluidizing the sections 68, 70, 74 and 76 and thus allowing all of the solids to bypass through the sections 72*b*, 78 and 50*c* as described above, the sections 68, 70, 72*a*, 74 and 76 can be partially fluidized so that only a portion of the solids bypass directly through the sections 72*b*, 78 and 50*c*, and thus pass directly into the enclosure 12. The remaining portion of the solids would thus pass in the standard manner through one or more of the sections 68, 70, 74 and 76 to remove heat therefrom, as described above, resulting in less heat removal from the solids when compared to the standard operation described above in which all of the solids pass through the sections 68, 70, 74 and 76.

Also, the fluidization could be varied so that the solids bypass one of the sections 68 and 70 as described in the bypass operation, above, and pass through the other as well as bypass one of the sections 74 and 76 and pass through the other. Moreover, during the standard operation, the fluidization, and the resulting heat removal, can be varied between the sections 68 and 70 and between the section 74 and 76, especially if these sections perform different functions (such as superheat, reheat, and the like). For example, the respective fluidization can be controlled so that 70% of the solids pass through the section 68 and 30% pass through the section 70 and so that 60% of the solids pass through the section 74 and 40% pass through the section 76, with these percentages being variable in accordance with particular design requirements.

In addition to providing the flexibility of operation discussed above, the present invention enjoys several other advantages. For example, a significant amount of heat can be removed from the solids circulating through the recycle heat exchanger 38 to maintain the desired temperature within the furnace for optimum fuel burn-up and emissions control. Also, the aforementioned selective fluidization, including the bypass modes, is done utilizing non-mechanical techniques. Moreover, the use of a pressurized system enables the separator to be relatively small, thus making room for the stacked heat exchange sections in the enclosure 40 to minimize the pressure vessel diameter.

It is understood that several variations can be made in the foregoing without departing from the scope of the invention. For example, an optional opening 15*d* (FIG. 5) can be provided in the wall 15*a* which permits the fluidizing air from all of the heat exchange sections 68, 70, 74 and 76 to be vented into the furnace enclosure instead of through the openings 15*b* and 15*c* along with the solids. This venting of the air in this manner through the opening 15*d* would enable the air to enter the furnace at a higher level and function as secondary air. In this arrangement, the solids would still be returned to the enclosure 12 through the openings 15*b* and 15*c* but would be allowed to build up to a sufficient level to balance the pressure difference between the openings 15*b*, 15*c*, and 15*d*.

It is also understood that the number and location of the various other openings in the walls of the enclosures 12 and 40 can be varied, and more than one separator can be utilized. Further, although the present invention has been described in connection with a pressurized fluidized bed boiler, it is understood that it is equally applicable to an atmospheric fluidized bed boiler. Examples of the latter are fully disclosed in U.S. Pat. No. 5,133,943 and No. 5,140,950, both assigned to the assignee of the present invention. Further, although a J-valve 32 was utilized in the preferred embodiment described above, it is understood that it could be replaced with another type of pressure sealing device within the scope of the invention. Examples of pressure sealing devices that would be applicable in this context are an L-valve, a seal pot, an N-valve or any other non-mechanical sealing device. Finally, although the preferred embodiment described above utilized two upper heat exchange sections 68 and 70 and two lower heat exchange sections 74 and 76, it is within the scope of the present invention to vary the number of these sections. Thus, in smaller systems one upper and/or lower heat exchange section can be used while larger systems may employ three or more.

Other variations in the present invention are contemplated and in some instances, some features of the invention can be employed without a corresponding use of other features. Accordingly, it is appropriate that the appended claims be construed broadly in a manner consistent with the scope of the invention.

What is claimed is:

1. A fluidized bed combustion system comprising a furnace; means for establishing a fluidized bed containing particulate material including fuel in the furnace whereby flue gases produced as a result of combustion of the fuel entrain a portion of the particles; means for separating the entrained particles from the flue gases; and a heat exchanger comprising an inlet compartment for receiving the separated particles, a first heat exchange compartment communicating with the inlet compartment for receiving the separated particles, a second heat exchange compartment disposed below the first heat exchange compartment, a transfer compartment communicating with the first heat exchange compartment and the second heat exchange compartment for transferring the separated particles from the first heat exchange compartment to the second heat exchange compartment, an outlet compartment section communicating with the heat exchange compartment and with the furnace for discharging the separated particles back to the furnace, and an additional outlet compartment section communicating with the inlet compartment and with the first-mentioned outlet compartment section for directly receiving the separated particles, wherein the fluidizing mean selectively fluidizes the particles in the compartments so that they pass from the inlet compartment, through the first heat exchange compartment, through the transfer compartment, through the second heat exchange compartment, and through the first-mentioned outlet compartment section to the furnace, or from the inlet compartment, through the first and second outlet compartment sections and to the furnace.

2. The system of claim 1 wherein the transfer compartment is located behind the inlet compartment and wherein the separated particles fall by gravity from the upper portion of the transfer compartment to the lower portion thereof.

3. The system of claim 1 further comprising heat exchange means disposed in the heat exchange compartments for cooling the separated particles in the latter compartments.

4. The system of claim 1 wherein the fluidizing means comprises means for selectively introducing air into the compartments.

5. The system of claim 4 wherein the outlet compartment section and the furnace share a common wall and further comprising a first opening extending through a lower portion of the common wall, and a second opening extending through the wall above the first opening, whereby the particles pass through the first opening into the furnace and a portion of the air passes through the second opening into the furnace.

6. A heat exchanger for receiving and treating separated particles from a fluidized bed combustion system including a furnace, the heat exchanger comprising an inlet compartment for receiving the separated particles, a first heat exchange compartment communicating with the inlet compartment for receiving the separated particles, a second heat exchange compartment disposed below the first heat exchange compartment, a transfer compartment communicating with the first heat exchange compartment and the second heat exchange compartment for transferring the separated particles from the first heat exchange compartment to the second heat exchange compartment, an outlet compartment section communicating with the heat exchange compartment and with the furnace for discharging the separated particles back to the furnace, and an additional outlet compartment section communicating with the inlet compartment and with the first-mentioned outlet compartment section for directly receiving the separated particles, whereby the fluidizing mean selectively fluidizes the particles in the compartments so that they pass from the inlet compartment, through the first heat exchange compartment, through the transfer compartment, through the second heat exchange compartment, and through the first-mentioned outlet compartment section to the furnace, or from the inlet compartment, through the first and second outlet compartment sections and to the furnace.

7. The heat exchanger of claim 6 wherein the transfer compartment is located behind the inlet compartment and wherein the separated particles fall by gravity from the upper portion of the transfer compartment to the lower portion thereof.

8. The heat exchanger of claim 6 further comprising heat exchange means disposed in the heat exchange compartments for cooling the separated particles in the latter compartments.

9. The heat exchanger of claim 6 wherein the fluidizing means comprises means for selectively introducing air into the compartments.

10. The heat exchanger of claim 8 wherein the outlet compartment section and the furnace share a common wall and further comprising a first opening extending through a lower portion of the common wall, and a second opening extending through the wall above the first opening, whereby the particles pass through the first opening into the furnace and a portion of the air passes through the second opening into the furnace.

11. A method of combustion comprising the steps of establishing a fluidized bed containing particulate material including fuel in a furnace whereby flue gases produced as a result of combustion of the fuel entrain a portion of the particles, separating the entrained particles from the flue gases, passing the separated particles to an inlet compartment of a heat exchange, passing the separated particles from the inlet compartment to a first heat exchange compartment, passing the separated particles from the first heat exchange compartment to a second heat exchange compartment disposed below the first heat exchange compartment, and passing the separated particles from the second heat exchange compartment back to the furnace.

12. The method of claim 11 wherein the transfer compartment is located behind the inlet compartment and wherein the separated particles fall by gravity from the upper portion of the transfer compartment to the lower portion thereof.

13. The method of claim 11 further comprising the step of responding to low load or start-up conditions and passing the separated particles directly from the inlet compartment to the outlet compartment section, and passing the separated particles from the outlet compartment section to the furnace.

14. The method of claim 11 further comprising the step of cooling the particles in the heat exchange compartment.

15. A fluidized bed combustion system comprising a furnace; means for establishing a fluidized bed containing particulate material including fuel in the furnace whereby flue gases produced as a result of combustion of the fuel entrain a portion of the particles; means for separating the entrained particles from the flue gases; and a heat exchanger comprising an inlet compartment for receiving the separated particles, a heat exchange compartment communicating with the inlet compartment for receiving the separated particles, a first outlet compartment section communicating with the inlet compartment for receiving the separated particles, a second outlet compartment section communicating with the heat exchange compartment and the inlet compartment for receiving the separated particles, the second outlet compartment section communicating with the furnace for discharging the separated particles back to the furnace, means for selectively fluidizing the particles in the compartments so that they pass from the inlet compartment, through the heat exchange compartment and the second outlet compartment section to the furnace, or from the inlet compartment, through the first and second outlet compartment sections and to the furnace, an additional heat exchange compartment communicating with the inlet compartment for receiving a portion of the particles, a third outlet compartment section communicating with the additional heat exchange compartment and the inlet compartment for receiving the portion of the particles, the third outlet compartment section communicating with the furnace for discharging the portion of the particles back to the furnace, and means for selectively fluidizing the particles in the additional heat exchange compartment and the third outlet compartment section so that they pass through the additional heat exchange compartment and the third outlet compartment section to the furnace, or from the inlet compartment, through the third outlet compartment section and to the furnace.

16. The system of claim 15 further comprising heat exchange means disposed in the heat exchange compartments for cooling the separated particles in the latter compartments.

17. The system of claim 15 wherein the fluidizing means comprises means for selectively introducing air into the compartments.

18. The system of claim 15 wherein the first outlet compartment section and the furnace share a common wall and further comprising a first opening extending through a lower portion of the wall, and a second opening extending through the wall above the first opening, whereby the particles pass through the first opening into the furnace, and a portion of the air passes through the second opening into the furnace.

19. A fluidized bed combustion system comprising a furnace; means for establishing a fluidized bed containing particulate material including fuel in the furnace whereby flue gases produced as a result of combustion of the fuel entrain a portion of the particles; means for separating the entrained particles from the flue gases; and a heat exchanger comprising an inlet compartment for receiving the separated particles, a heat exchange compartment communicating with the inlet compartment for receiving the separated particles, a first outlet compartment section communicating with the inlet compartment for receiving the separated particles, a second outlet compartment section communicating with the heat exchange compartment and the inlet compartment for receiving the separated particles, the second outlet compartment section communicating with the furnace for discharging the separated particles back to the furnace, and means for selectively introducing air into the compartments to fluidize the particles in the compartments so that they pass from the inlet compartment, through the heat exchange compartment and the second outlet compartment section to the furnace, or from the inlet compartment, through the first and second outlet compartment sections and to the furnace, wherein the first outlet compartment section and the furnace share a common wall and further comprising a first opening extending through a lower portion of the wall, and a second opening extending through the wall above the first opening, whereby the particles pass through the first opening into the furnace and a portion of the air passes through the second opening into the furnace.

20. The system of claim 19 further comprising heat exchange means disposed in the heat exchange compartment for cooling the separated particles in the latter compartment.

21. A heat exchanger for receiving and treating separated particles from a fluidized bed combustion system including a furnace, the heat exchanger comprising an inlet compartment for receiving the separated particles, a heat exchange compartment communicating with the inlet compartment for receiving the separated particles, a first outlet compartment section communicating with the inlet compartment for receiving the separated particles, a second outlet compartment section communicating with the heat exchange compartment and the inlet compartment for receiving the separated particles, the second outlet compartment section communicating with the furnace for discharging the separated particles back to the furnace, means for selectively fluidizing the particles in the compartments so that they pass from the inlet compartment, through the heat exchange compartment and the second outlet compartment section to the furnace, or from the inlet compartment, through the first and second outlet compartment sections and to the furnace, an additional heat exchange compartment communicating with the inlet compartment for receiving a portion of the particles, a third outlet compartment section communicating with the additional heat exchange compartment and the inlet compartment for receiving the portion of the particles, the third outlet compartment section communicating with the furnace for discharging the portion of the particles back to the furnace, and means for selectively fluidizing the particles in the additional heat exchange compartment and the third outlet compartment section so that they pass through the additional heat exchange compartment and the third outlet compartment section to the furnace, or from the inlet compartment, through the third outlet compartment section and to the furnace.

22. The heat exchanger of claim 21 further comprising heat exchange means disposed in the heat exchange compartments for cooling the separated particles in the latter compartments.

23. A heat exchanger for receiving and treating separated particles from a fluidized bed combustion system including a furnace, the heat exchanger comprising an inlet compartment for receiving the separated particles, a heat exchange compartment communicating with the inlet compartment for receiving the separated particles, a first outlet compartment section communicating with the inlet compartment for receiving the separated particles, a second outlet compartment section communicating with the heat exchange compartment and the inlet compartment for receiving the separated particles, the second outlet compartment section communicating with the furnace for discharging the separated particles back to the furnace, and means for selectively introducing air into the compartments to fluidize the separated particles in the compartments so that they pass from the inlet compartment, through the heat exchange compartment and the second outlet compartment section to the furnace, or from the inlet compartment, through the first and second outlet compartment sections and to the furnace, wherein the first outlet compartment section and the furnace share a common wall and further comprising a first opening extending through a lower portion of the wall to communicate the outlet compartment section with the furnace, and a second opening extending through the wall above the first opening, whereby the particles pass through the first opening and the air passes through the second opening.

24. The heat exchanger of claim 23 further comprising heat exchange means disposed in the heat exchange compartment for cooling the separated particles in the latter compartment.

* * * * *